US010186194B2

(12) United States Patent
Fujii

(10) Patent No.: US 10,186,194 B2
(45) Date of Patent: Jan. 22, 2019

(54) DISPLAY DEVICE AND METHOD OF DRIVING THE SAME

(71) Applicant: Samsung Display Co., Ltd., Yongin, Gyeonggi-Do (KR)

(72) Inventor: Mitsuru Fujii, Yongin (KR)

(73) Assignee: Samsung Display Co., Ltd. (KR)

( * ) Notice: Subject to any disclaimer, the term of this patent is extended or adjusted under 35 U.S.C. 154(b) by 72 days.

(21) Appl. No.: 14/933,730

(22) Filed: Nov. 5, 2015

(65) Prior Publication Data

US 2016/0071459 A1 Mar. 10, 2016

Related U.S. Application Data

(62) Division of application No. 14/038,520, filed on Sep. 26, 2013, now Pat. No. 9,218,758.

(30) Foreign Application Priority Data

May 10, 2013 (KR) ..... 10-2013-0053220

(51) Int. Cl.
*G09G 3/20* (2006.01)
*G09G 3/3233* (2016.01)
(Continued)

(52) U.S. Cl.
CPC ..... *G09G 3/3233* (2013.01); *G09G 3/2003* (2013.01); *G09G 3/3266* (2013.01);
(Continued)

(58) Field of Classification Search
CPC ..... G09G 3/2003; G09G 3/20; G09G 3/3291; G09G 3/3266; G09G 2300/0819; G09G 2320/0666; G09G 2310/0297; G09G 2320/0242; G09G 2320/043; G09G 2310/0262
(Continued)

(56) References Cited

U.S. PATENT DOCUMENTS

2006/0151745 A1* 7/2006 Kim ..... G09G 3/325 252/301.16
2006/0227628 A1 10/2006 Eriguchi et al.
(Continued)

FOREIGN PATENT DOCUMENTS

JP 2008-046485 2/2008
KR 10-2006-0033485 A 4/2006
KR 10-2008-0067489 A 7/2008

*Primary Examiner* — Towfiq Elahi
(74) *Attorney, Agent, or Firm* — Innovation Counsel LLP

(57) ABSTRACT

A display device is provided including a display unit including a plurality of color pixels; a scan driver that sequentially applies a gate-on voltage scan signal to a plurality of scan lines that are connected to the color pixels; a demux unit that is connected to a plurality of color data lines that are connected to the color pixels, and that sequentially selects the plurality color data lines at a predetermined time interval; and a data driver that applies a data signal to each of the plurality of color data lines that are sequentially selected in the demux unit, and that applies a previous data signal to at least one of the plurality of color data lines during the predetermined time interval, wherein the previous data signal has a same voltage as a voltage applied to one of the plurality of color data lines before the predetermined time interval.

6 Claims, 7 Drawing Sheets

(51) Int. Cl.
*G09G 3/3266* (2016.01)
*G09G 3/3275* (2016.01)

(52) U.S. Cl.
CPC ... *G09G 3/3275* (2013.01); *G09G 2310/0297* (2013.01); *G09G 2310/08* (2013.01); *G09G 2320/0219* (2013.01); *G09G 2330/021* (2013.01); *G09G 2330/025* (2013.01); *G09G 2330/028* (2013.01)

(58) Field of Classification Search
USPC ..... 345/690, 215, 99
See application file for complete search history.

(56) References Cited

U.S. PATENT DOCUMENTS

| | | | | |
|---|---|---|---|---|
| 2008/0067528 | A1 | 3/2008 | Choi et al. | |
| 2008/0170008 | A1 | 7/2008 | Kim | |
| 2010/0177090 | A1 | 7/2010 | Komiya | |
| 2012/0287148 | A1* | 11/2012 | Brown Elliott ..... | G09G 5/02 345/593 |

* cited by examiner

DISPLAY DEVICE AND METHOD OF DRIVING THE SAME

CROSS-REFERENCE TO RELATED APPLICATION

This application is a divisional application of U.S. patent application Ser. No. 14/038,520 filed on Sep. 26, 2013, which claims priority to Korean Patent Application No. 10-2013-0053220 filed in the Korean Intellectual Property Office on May 10, 2013, and all the benefits accruing therefrom under 35 U.S.C. § 119, the entire contents of the prior applications being herein incorporated by reference.

BACKGROUND (a) Field

Embodiments of the present invention relate to a display device and a method of driving the same. More particularly, the present invention relates to an active matrix display device and a method of driving the same.

(b) Description of the Related Art

An organic light emitting diode (OLED) display uses OLEDs in which luminance is controlled by a current or a voltage. An OLED includes a positive electrode layer and a negative electrode layer that form an electric field, and an organic light emitting material that emits light due to the electric field.

In general, OLEDs are classified into either a passive matrix OLED (PMOLED) or an active matrix OLED (AMOLED) based on the driving method of the OLED.

AMOLEDs that can selectively lighten in every unit pixel are advantageous from the viewpoint of resolution, contrast, and operation speed, and are thus a widely used type of OLED. A frame period for an AMOLED includes a scan period that writes image data and a light emitting period that emits light based on the written image data.

In a display panel, a plurality of scan lines to which a scan signal is applied and a plurality of data lines to which a data signal is applied are arranged, and at an intersection of the scan line and the data line, a pixel is formed. The display panel also includes a power source wire entirely formed in over the display panel. The power source wire is applied with a power supply voltage to cause the OLED to emit light.

During a scan period, a scan signal of a gate-on voltage is sequentially applied to the plurality of scan lines, and a data signal is applied to the plurality of data lines to correspond to a scan signal of a gate-on voltage, and thus image data is written at a plurality of pixels. Data signals are applied to the plurality of data lines with a controlled slew rate (i.e., a controlled rise rate of the voltage). Cases may occur, however, in which a data signal is applied to a plurality of data lines without being substantially controlled by the slew rate. In such a case, the voltage of the data line may be rapidly changed. Because wire resistance exists at the power supply wire, as a result of parasitic capacitance between the data line and power supply wire, the power supply voltage may be then be rapidly changed. A rapid change in the power supply voltage may have a harmful influence on the image quality. Furthermore, in a touch screen in which a touch sensor is formed adjacent to the display panel, as the result of such instantaneous rapid change in the power supply voltage, coupling noise occurs between a wire of the touch sensor and the power supply wire, and as a result of such coupling noise, a touch detection error may occur.

The above information disclosed in this Background section is only for enhancement of understanding of the background of the disclosure and therefore it may contain information that does not form the prior art that is already known to a person of ordinary skill in the art.

SUMMARY

A display device and a method of driving the same are provided having advantages of removing coupling noise by suppressing a rapid voltage change of a data line.

A display device includes: a display unit including a plurality of first color pixels, a plurality of second color pixels, and a plurality of third color pixels; a scan driver configured to sequentially apply a scan signal having a gate-on voltage to a plurality of scan lines that are connected to the plurality of first color pixels, the plurality of second color pixels, and the plurality of third color pixels; a demux unit that is connected to a plurality of first color data lines that are connected to the plurality of first color pixels, a plurality of second color data lines that are connected to the plurality of second color pixels, and a plurality of third color data lines that are connected to the plurality of third color pixels and is configured to sequentially select the plurality of first color data lines, the plurality of second color data lines, and the plurality of third color data lines at a predetermined time interval; and a data driver configured to apply a data signal to each of the plurality of first color data lines, the plurality of second color data lines, and the plurality of third color data lines that are sequentially selected in the demux unit, and configured to apply a previous data signal to at least one of the plurality of first color data lines, the plurality of second color data lines, and the plurality of third color data lines during the predetermined time interval, wherein the previous data signal has a same voltage as a voltage applied to one of the plurality of first color data lines, the plurality of second color data lines, and the plurality of third color data lines at an immediately preceding scan line before the predetermined time interval.

The demux unit may repeatedly select the plurality of first color data lines, the plurality of second color data lines, and the plurality of third color data lines in a scan line unit.

The data driver may apply a plurality of previous data signals for a first color to the plurality of first color data lines during a first time interval before the plurality of first color data lines are selected, apply a plurality of previous data signals for a second color to the plurality of second color data lines during a second time interval before the plurality of second color data lines are selected, and apply a plurality of previous data signals for a third color to the plurality of third color data lines for a third time interval before the plurality of third color data lines are selected.

The demux unit may include a first color transistor that connects the plurality of first color data lines to the data driver in response to a first color selection signal; a second color transistor that connects the plurality of second color data lines to the data driver in response to a second color selection signal; and a third color transistor that connects the plurality of third color data lines to the data driver in response to a third color selection signal.

The first time interval may be a time interval between a time when an on-voltage is applied to a horizontal synchronization signal in a scan line unit and a time when a gate-on voltage is applied to the first color selection signal.

The second time interval may be a time interval between the time at which the gate-on voltage is applied to the first color selection signal and a time at which a gate-on voltage is applied the second color selection signal.

The third time interval may be a time interval between the time at which the gate-on voltage is applied to the second color selection signal and a time at which a gate-on voltage is applied to the third color selection signal.

The demux unit may sequentially select the plurality of first color data lines, the plurality of second color data lines, and the plurality of third color data lines at a first scan line segment and sequentially select the plurality of third color data lines, the plurality of second color data lines, and the plurality of third color data lines at a second scan line segment after the first scan line segment.

In another aspect, a display device includes: a display unit including a plurality of first color pixels, a plurality of second color pixels, and a plurality of third color pixels; a scan driver that sequentially applies a gate-on voltage scan signal to a plurality of scan lines that are connected to the plurality of first color pixels, the plurality of second color pixels, and the plurality of third color pixels; a demux unit that is connected to a plurality of first sub-data lines and a plurality of second sub-data lines, the plurality of first sub-date lines are connected to the plurality of first color pixels and the plurality of third color pixels, and the plurality of second sub-data lines that are connected to the plurality of second color pixels, wherein the demux unit is configured to sequentially select the plurality of first sub-data lines and the plurality of second sub-data lines at a predetermined time interval; and a data driver configured to apply a data signal to each of the plurality of first sub-data lines and the plurality of second sub-data lines that are sequentially selected in the demux unit, and configured to apply a previous data signal to the plurality of first sub-data lines and the plurality of second sub-data lines, wherein the previous data signal has a same voltage as a voltage applied to one of the plurality of first sub-data lines and the plurality of second sub-data lines at an immediately preceding scan line before the predetermined time interval.

The demux unit may repeatedly select the plurality of first sub-data lines and the plurality of sub-data lines in a scan line unit.

The data driver may apply a first previous data signal applied to the plurality of first sub-data lines at a first scan line segment to the first sub-data line during a first time interval before the plurality of first sub-data lines are selected at a second scan line segment following the first scan line segment, and may apply a second previous data signal applied to the plurality of first sub-data lines at the second scan line segment to the first sub-data line during the first time interval that is included in a third scan line segment following the second scan line segment.

The data driver may apply a third previous data signal applied to the plurality of second sub-data lines at the first scan line segment to the second sub-data line during a second time interval before the plurality of second sub-data lines are selected at the second scan line segment, and may apply a fourth previous data signal applied to the plurality of second sub-data lines at the second scan line segment to the second sub-data line during the second time interval at the third scan line segment.

In yet another aspect, a method of driving a display device is provided, the method including: applying a first data signal having a same voltage as a data signal applied to a first color data line at a first scan line segment to the first color data line during a first time interval that is included in a second scan line segment that follows the first scan line segment; applying a third data signal to the first color data line to which the first data signal is applied; applying a second data signal having a same voltage as a data signal applied to a second color data line during the first scan line segment to the second color data line during a second time interval that is included in the second scan line segment; and applying a fourth data signal to the second color data line to which the second data signal is applied, wherein a first color pixel is connected to the first color data line, and a second color pixel is connected to the second color data line.

The method may further include: applying a fifth data signal having a same voltage as a data signal applied to a third color data line during the first scan line segment to the third color data line during a third time interval that is included in the second scan line segment; and applying a sixth data signal to the third color data line to which the fifth data signal is applied, wherein a third color pixel may be connected to the third color data line.

The first time interval may be a time period between a time when an on-voltage is applied to a horizontal synchronization signal a scan line unit and a time at which the third data signal is applied to the first color data line.

The second time interval may be a time period between the time at which the third data signal is applied to the first color data line and a time at which the fourth data signal is applied to the second color data line.

The third time interval may be a time period between the time at which the fourth data signal is applied to the second color data line and a time at which the sixth data signal is applied to the third color data line.

A third color pixel may be further connected to the first color data line, and the method may further include applying a third data signal having a same voltage as a data signal applied to the first color data line at the second scan line segment to the first color data line during a first time interval that is included in the third scan line segment.

In yet another aspect, a method of driving a display device is provided, the method including: selecting a plurality of first color data lines that are connected to a plurality of first color pixels, a plurality of second color data lines that are connected to a plurality of second color pixels, and a plurality of third color data lines that are connected to a plurality of third color pixels at a predetermined time interval and applying a data signal to the selected color data lines; and applying a data signal having a same voltage as a data signal applied to at least one of the plurality of first color data lines, the plurality of second color data lines, and the plurality of third color data lines at an immediately preceding scan line before the predetermined time interval to at least one of the plurality of first color data lines, the plurality of second color data lines, and the plurality of third data lines during the predetermined time interval.

The plurality of first color data lines, the plurality of second color data lines, and the plurality of third color data lines may be repeatedly selected in a scan line unit.

At a data line, a rapid voltage change of a data voltage can be removed, and thus a power supply voltage can be prevented from being rapidly changed by a parasitic capacitor component of a data line and a power supply wire.

In a touch screen, by reducing coupling noise between a wire of a touch sensor and a power supply wire, a touch detection error can be prevented from occurring.

DETAILED DESCRIPTION

Figure 1:
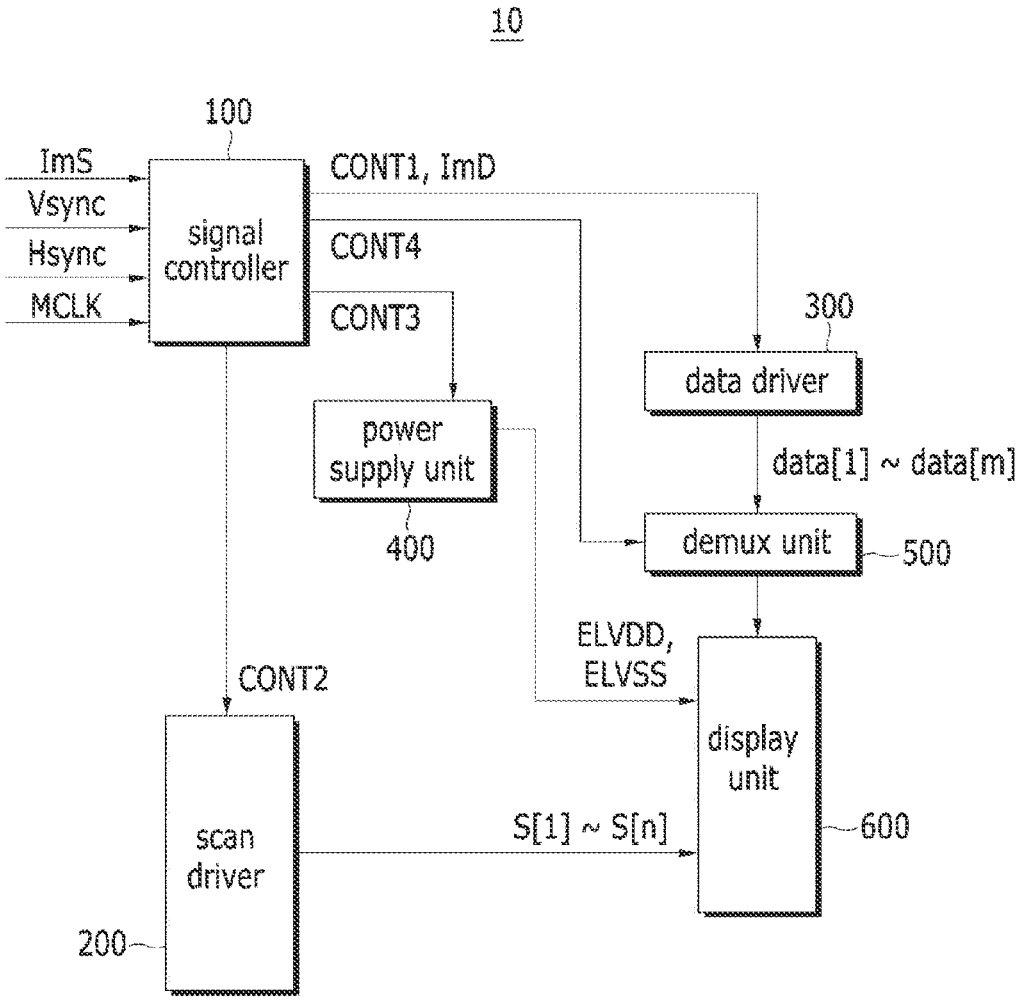
FIG. 1 is a block diagram illustrating a display device according to an example embodiment.

Example embodiments will be described more fully hereinafter with reference to the accompanying drawings, in which example embodiments are shown. As those skilled in the art would realize, the described embodiments may be modified in various different ways, all without departing from the spirit or scope of the present disclosure.

Further, like reference numerals designate like elements in several example embodiments and are representatively described in the first example embodiment and elements different from those of the first example embodiment will be described in other example embodiments.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram illustrating a display device according to an example embodiment.

Referring to FIG. 1, a display device 10 includes a signal controller 100, a scan driver 200, a data driver 300, a power supply unit 400, a demux unit 500, and a display unit 600.

The signal controller 100 receives a video signal ImS and a synchronization signal that are input from an external device. The video signal ImS contains the luminance information for a plurality of pixels. The luminance information has grays (i.e., gray values) on a scale of a predetermined number, for example, 1024 (=210), 256 (=$2^8$), or 64 (=$2^6$). The synchronization signal includes a horizontal synchronization signal Hsync, a vertical synchronization signal Vsync, and a main clock signal MCLK.

The signal controller 100 generates first to fourth driving control signals CONT1, CONT2, CONT3, and CONT4 and an image data signal ImD based on the video signal ImS, the horizontal synchronization signal Hsync, the vertical synchronization signal Vsync, and the main clock signal MCLK.

The signal controller 100 divides the video signal ImS into frame units based on the vertical synchronization signal Vsync, divides the video signal ImS into scan line units based on the horizontal synchronization signal Hsync, and generates an image data signal ImD. The signal controller 100 transmits the image data signal ImD together with the first driving control signal CONT1 to the data driver 300.

The display unit 600 is a display area that includes a plurality of pixels. In the display unit 600, a plurality of scan lines that are extended in an approximately row direction so as to be almost parallel to each other, and a plurality of data lines that are extended in an approximately column direction so as to be almost parallel to each other, are formed and are connected to the pixels. In the display unit 600, a plurality of power supply lines for supplying a first power supply voltage ELVDD and a second power supply voltage ELVSS to the pixels are formed and are connected to the pixels.

The pixels may each emit light having one of a set of primary colors. The set of primary colors may include, for example, red, green, and blue, and a desired color may be displayed with a spatial sum or a temporal sum of the primary colors. A color may be displayed by a red pixel, a green pixel, and a blue pixel, and the combination of the red pixel, the green pixel, and the blue pixel is referred to as a color-combined pixel.

The scan driver 200 is connected to a plurality of scan lines and generates a plurality of scan signals S[1]-S[n], which are based the second driving control signal CONT2. The scan driver 200 sequentially applies scan signals S[1]-S[n] having a gate-on voltage to the plurality of scan lines.

The data driver 300 is connected to a plurality of data lines. The data driver 300 samples and holds an input image data signal ImD, which is based on the first driving control signal CONT1, and transfers a plurality of data signals data[1]-data[m] to each of the plurality of data lines. The data driver 300 applies data signals data[1]-data[m] having a predetermined voltage range to the plurality of data lines in response to the scan signals S[1]-S[n] having the gate-on voltage.

The power supply unit 400 is connected to a plurality of power supply lines and adjusts the power supply level of the first power supply voltage ELVDD and the second power supply voltage ELVSS based on the third driving control signal CONT3.

The demux unit 500 applies data signals data[1]-data[m] that are input from the data driver 300 to a red pixel, a green pixel, and a blue pixel, of a pixel based on the fourth driving control signal CONT4.

Figure 2:
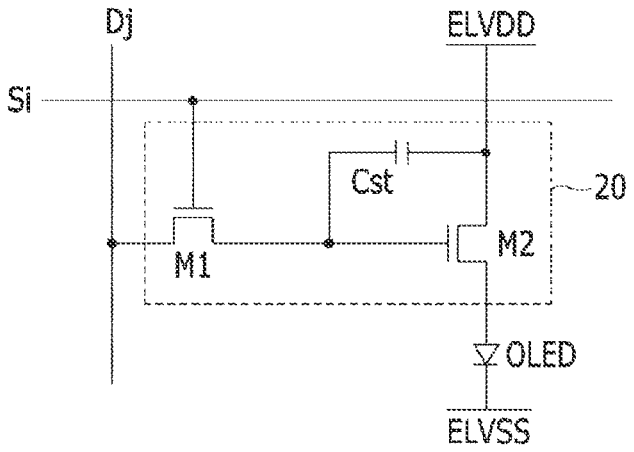
FIG. 2 is a circuit diagram illustrating a pixel according to an example embodiment.

FIG. 2 is a circuit diagram illustrating a pixel according to an example embodiment.

Referring to FIG. 2, a pixel of an OLED display includes an OLED and a pixel circuit 20 for controlling the OLED. The pixel circuit 20 includes a switching transistor M1, a driving transistor M2, and a storage capacitor Cst.

In the example illustrated in FIG. 2, the pixel circuit 20 is formed with two transistors, M1 and M2, and one capacitor Cst, but a pixel circuit of the OLED display may be variously formed and operated, and the display device 10 is not limited to a configuration of a pixel circuit.

The switching transistor M1 includes a gate electrode that is connected to a scan line Si, one electrode that is connected to a data line Dj, and the other electrode that is connected to a gate electrode of the driving transistor M2. For Si and Dj, $1 \le i \le n$, and $1 \le j \le m$.

The driving transistor M2 includes a gate electrode that is connected to the other electrode of the switching transistor M1, one electrode that is connected to the first power supply voltage ELVDD, and the other electrode that is connected to an anode of the OLED.

The storage capacitor Cst includes one electrode that is connected to the first power supply voltage ELVDD and the other electrode that is connected to a gate electrode of the driving transistor M2. The storage capacitor Cst charges a data voltage that is applied to the gate electrode of the driving transistor M2 and maintains the charge of the data voltage even after the switching transistor M1 is turned off.

The OLED includes an anode that is connected to the other electrode of the driving transistor M2 and a cathode that is connected to the second power supply voltage ELVSS. The OLED may emit light having one of a set of primary colors. Example primary colors include red, green, and blue, and a desired color may be displayed with a spatial sum or a temporal sum of the primary colors.

An organic emission layer of the OLED may be made, for example, of a low polymer organic material or a high polymer organic material such as poly 3,4-ethylenedioxythiophene (PEDOT). Further, the organic emission layer may be formed with multiple layers that include at least one of an emission layer, a hole injection layer (HIL), a hole transporting layer (HTL), an electron transporting layer (ETL), and an electron injection layer (EIL). When the organic emission layer includes the emission layer, the HIL, the HTL, the ETL, and the EIL, the HIL is disposed on a pixel electrode, which is a positive electrode, and the HTL, the emission layer, the ETL, and the EIL are sequentially stacked thereon.

The organic emission layer may include a red organic emission layer that emits a red color, a green organic emission layer that emits a green color, and a blue organic emission layer that emits a blue color. The red organic emission layer, the green organic emission layer, and the blue organic emission layer are formed, respectively, at a red pixel, a green pixel, and a blue pixel, to embody a color image.

Additionally, the red organic emission layer, the green organic emission layer, and the blue organic emission layer are stacked in the organic emission layer of, respectively, red pixels, green pixels, and blue pixels. The red, green and blue organic emission layer therefore form red, green and blue colors, on a pixel basis, thereby embodying a color image. In another example, a white organic emission layer that emits white at from all of the red, green and blue pixels is instead formed, and red, green and blue color filters are also formed, on a pixel basis, so that a color image may be embodied. When a color image is embodied using a white organic emission layer and a color filter, it is not necessary to use a deposition mask for separately depositing a red organic emission layer, a green organic emission layer, and a blue organic emission layer at respective individual pixel, i.e., a red pixel, a green pixel, and a blue pixel.

The white organic emission layer may be formed as a single organic emission layer and includes a configuration that may emit white by stacking a plurality of organic emission layers. For example, the white organic emission layer may include a configuration that may emit white by combining at least one yellow organic emission layer and at least one blue organic emission layer, a configuration that may emit white by combining at least one cyan organic emission layer and at least one red organic emission layer, and a configuration that may emit white by combining at least one magenta organic emission layer and at least one green organic emission layer.

The switching transistor M1 and the driving transistor M2 may each be, for example, a p-channel field effect transistor. In this case, a gate-on voltage that turns on the switching transistor M1 and the driving transistor M2 is a low level voltage, and a gate-off voltage that turns off the switching transistor M1 and the driving transistor M2 is a high level voltage.

While a p-channel field effect transistor is illustrated, at least one of the switching transistor M1 and the driving transistor M2 may be, for example, an n-channel field effect transistor. A gate-on voltage that turns on the N-channel field effect transistor is a high level voltage, and a gate-off voltage that turns off the N-channel field effect transistor is a low level voltage.

At least one of the switching transistor M1 and the driving transistor M2 may be, for example, an oxide thin film transistor (TFT) in which a semiconductor layer is formed with an oxide semiconductor.

The oxide semiconductor may, for example, include an oxide based on titanium (Ti), hafnium (Hf), zirconium (Zr), aluminum (Al), tantalum (Ta), germanium (Ge), zinc (Zn), gallium (Ga), tin (Sn), or indium (In), and zinc oxide (ZnO), indium-gallium-zinc oxide (InGaZnO4), indium-zinc oxide (Zn—In—O), zinc-tin oxide (Zn—Sn—O), indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), and hafnium-indium-zinc oxide (Hf—In—Zn—O), which are a composite oxide thereof.

The semiconductor layer includes a channel area in which impurities are not doped and a source area and a drain area that are formed with doped impurities at both sides of the channel area. The impurities used to dope the source and drain areas may be an N-type impurities or a P-type impurities, and are chosen based on the type of thin film transistor desired.

When a semiconductor layer is formed with an oxide semiconductor, in order to protect an oxide semiconductor, which is weak, from an outer environment, such as exposure to a high temperature, a separate protection layer may be added.

Operation of the Pixel Will be Briefly Described.

When a gate-on voltage is applied to the scan line Si, the switching transistor M1 is turned on, and a data signal that is applied to the data line Dj is applied to the other electrode of the storage capacitor Cst to charge the storage capacitor Cst. The driving transistor M2 controls the amount of current flowing from the first power supply voltage ELVDD to the OLED, so as to correspond to a voltage that is charged at the storage capacitor Cst. A current flowing from the first power supply voltage ELVDD through the driving transistor M2 flows to the OLED. The OLED generates light with a brightness that corresponds to the amount of current flowing through the driving transistor M2.

Figure 3:
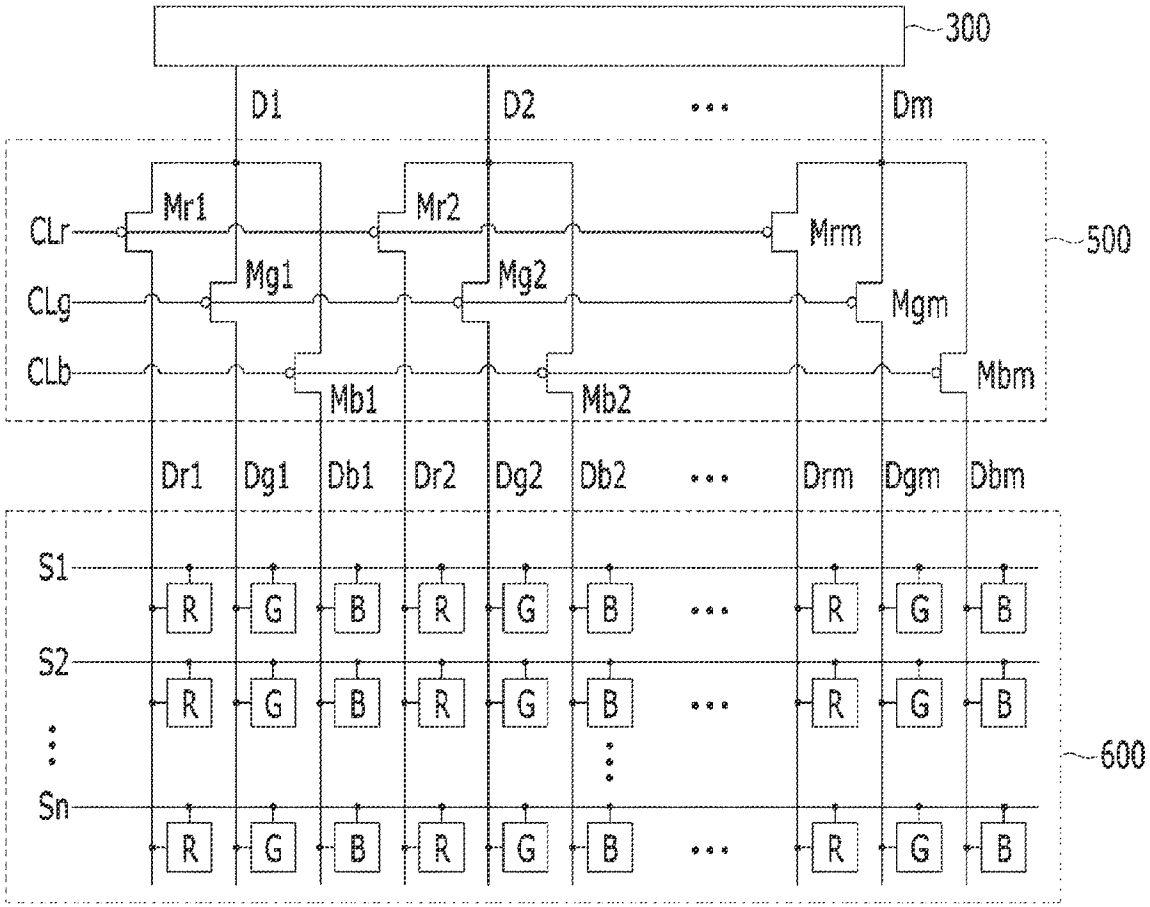
FIG. 3 is a circuit diagram illustrating a configuration of a display device according to an example embodiment.

FIG. 3 is a circuit diagram illustrating a configuration of a display device according to an example embodiment.

Referring to FIG. 3, a plurality of pixels are disposed, for example, in an array, in the display unit 600. The plurality of pixels includes a plurality of red pixels R, a plurality of green pixels G, and a plurality of blue pixels B. Each of the red pixels R are connected to one of a plurality of red data lines Dr1-Drm, each of the green pixels G are connected to one of a plurality of green data lines Dg1-Dgm, and each of the blue pixels B are connected to one of a plurality of blue data lines Db1-Dbm. A pixel array structure that displays a desired color image is formed by a temporal sum or a spatial sum of light that is generated at the red pixels R, the green pixels G, and the blue pixels B.

The demux unit 500 includes a plurality of red transistors Mr1-Mrm, a plurality of green transistors Mg1-Mgm, and a plurality of blue transistors Mb1-Mbm that are turned on and off based on the fourth driving control signal CONT4.

The demux unit 500 generates a red selection signal CLr that controls the red transistors Mr1-Mrm, a green selection signal CLg that controls the green transistors Mg1-Mgm, and a blue selection signal CLb that controls the blue transistors Mb1-Mbm based on the fourth driving control signal CONT4. Alternatively, the red selection signal CLr, the green selection signal CLg, and the blue selection signal CLb may be included in the fourth driving control signal CONT4.

Each of the red transistors Mr1-Mrm includes a gate electrode to which the red selection signal CLr is applied, one electrode that is connected to one of the data lines D1-Dm, and the other electrode that is connected to one of the red data lines Dr1-Drm.

Each of the green transistors Mg1-Mgm includes a gate electrode to which the green selection signal CLg is applied, one electrode that is connected to one of the data lines D1-Dm, and the other electrode that is connected to one of the green data lines Dg1-Dgm.

Each of the blue transistors Mb1-Mbm includes a gate electrode to which a blue selection signal CLb is applied, one electrode that is connected to one of the data lines D1-Dm, and the other electrode that is connected to one of the blue data lines Db1-Dbm.

The red transistors Mr1-Mrm, the green transistors Mg1-Mgm, and the blue transistors Mb1-Mbm may be, for example, p-channel field effect transistors. The gate-on voltage for the p-channel field effect transistor is a low level voltage, and the gate-off voltage thereof is a high level voltage.

At least one of the red transistors Mr1-Mrm, the green transistors Mg1-Mgm, and the blue transistors Mb1-Mbm may be, for example, an n-channel field effect transistor. The gate-on voltage for the n-channel field effect transistor is a high level voltage, and the gate-off voltage thereof is a low level voltage.

Gate-on voltages may be repeatedly applied to red selection signal CLr, the green selection signal CLg, and the blue selection signal CLb at predetermined time intervals having a scan line unit. For example, after a gate-on voltage applied to the red selection signal CLr is changed to a gate-off voltage, a gate-on voltage is applied to the green selection signal CLg at a predetermined time interval. After the green selection signal CLg is changed to a gate-off voltage, a gate-on voltage may be applied to the blue selection signal CLb at a predetermined time interval.

During a period in the gate-on voltage is applied to the red selection signal CLr, the data driver 300 applies the data signals for the red pixels R to the data lines D1-Dm, which are thus applied to red data lines Dr1-Drm. During a period in which the gate-on voltage is applied to the green selection signal CLg, the data driver 300 applies the data signals for the green pixels G to the data lines D1-Dm, which are thus applied to the green data lines Dg1-Dgm. During a period in which a gate-on voltage is applied to the blue selection signal CLb, the data driver 300 applies the data signals for the blue pixels B to the data lines D1-Dm, which are thus applied to the blue data lines Db1-Dbm.

In this case, for a predetermined time interval before gate-on voltages are applied to the red selection signal CLr, the green selection signal CLg, and the blue selection signal CLb, the data driver 300 applies to the data lines D1-Dm, the same data signal as was applied to the data lines D1-Dm for the immediately preceding scan line. Thus, data signals having a voltage signal level are applied to pixels connected to an immediately preceding scan line in response to a gate-on signal applied to the scan line. Then, for the current scan line, the data lines D1-Dm are first charged with the voltage signal level previously applied, during the predetermined time interval.

Figure 4:
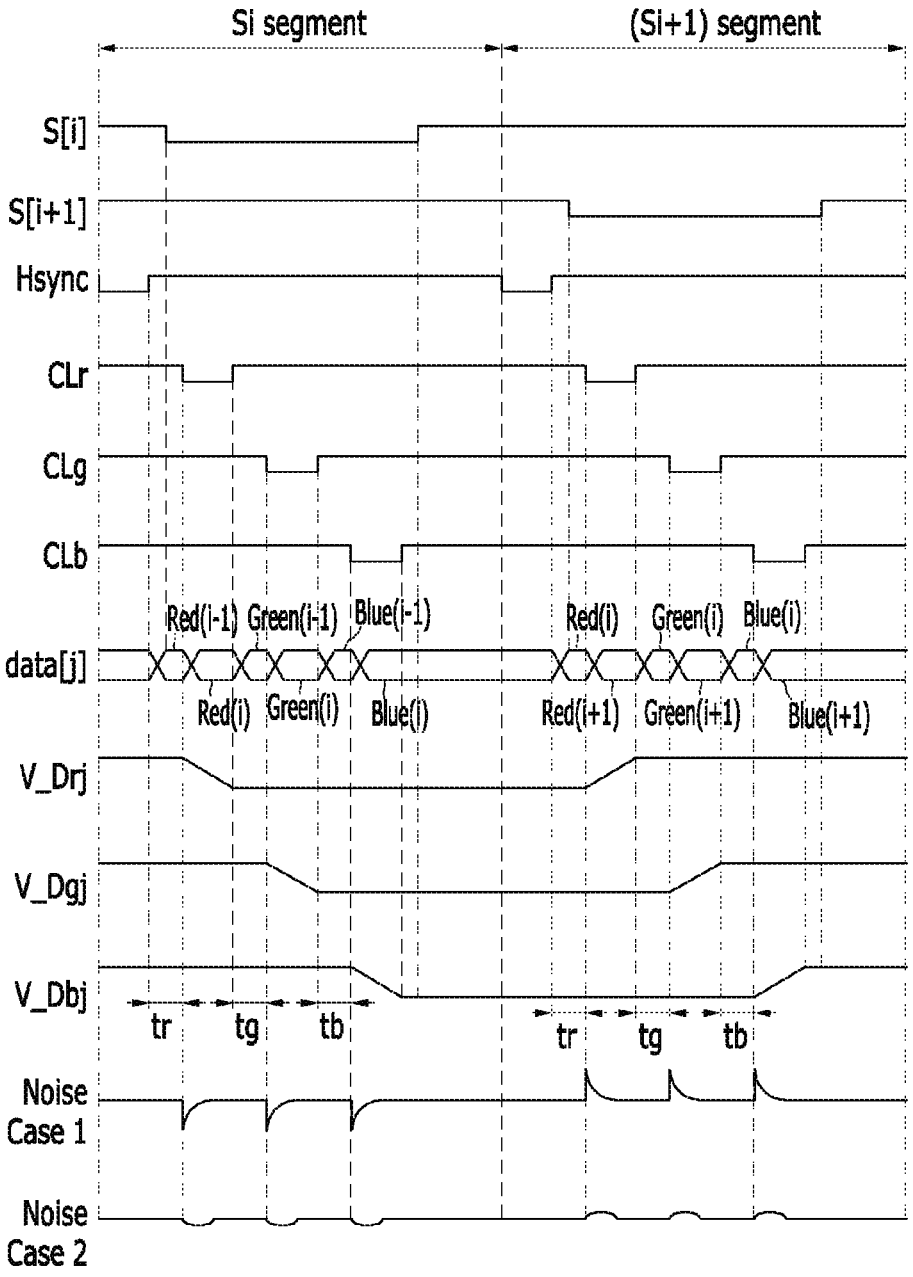
FIG. 4 is a timing diagram illustrating a method of driving a display device according to an example embodiment.

FIG. 4 is a timing diagram illustrating a method of driving a display device according to an example embodiment.

Referring to FIGS. 3 and 4, for better understanding and ease of description, an "Si segment," is a period of time in which a data signal corresponding to an i-th scan line Si is applied, and an "(Si+1) segment," is a period of time in which a data signal corresponding to an (i+1)th scan line (Si+1) is applied, are illustrated (in this case $2 \le i \le n-1$). A data signal, data[j], that is applied to a j-th data line Dj is illustrated (in this case $1 \le j \le m$).

An on-voltage (low level voltage) is applied to the horizontal synchronization signal Hsync, and is repeated in a scan line unit. The red selection signal CLr, the green selection signal CLg, and the blue selection signal CLb are synchronized with the horizontal synchronization signal Hsync, and a gate-on voltages are sequentially applied to the red selection signal CLr, the green selection signal CLg, and the blue selection signal CLb at predetermined time intervals tr, tg, and tb. A segment in which gate-on voltages are applied to the red selection signal CLr, the green selection signal CLg, and the blue selection signal CLb is included in a segment in which a scan signal is applied with a gate-on voltage.

At the Si segment, for a first time interval tr between the time when the horizontal synchronization signal Hsync changes voltage level and before a gate-on voltage is applied to the red selection signal CLr, the data signal data[j] has the value of the data signal previously applied to pixels connected to the (i−1)th scan line (Si−1), indicated in FIG. 4 as a red data signal Red(i)−1. Thereafter, when a gate-on voltage is applied to the red selection signal Clr, the data signal data[j] has the value, indicated in FIG. 4 as red data signal Red(i), corresponding to the data signal value to be applied to pixels connected to an i-th scan line Si. The red selection signal CLr provides the gate-on voltage to the red transistor Mrj, the red transistor Mrj is turned on, and a red data signal Red(i) is applied to a red data line Drj through the turned-on red transistor Mrj. In this case, the red data signal Red(i) is controlled and output with a lower slew rate, i.e., a slower rise/fall rate, to correspond to a period during which the red selection signal CLr has a gate-on voltage.

For a second time interval tg between the time when a gate-off voltage is applied to the red selection signal CLr and before a gate-on voltage is applied to the green selection signal CLg, a data signal data[j] has the value of the data signal previously applied to pixels connected to the (i−1)th scan line (Si−1), indicated in FIG. 4 as a green data signal Green(i−1). Thereafter, when a gate-on voltage is applied to the green selection signal Clg, the data signal data[j] has the value, indicated in FIG. 4 as green data signal Green(i), corresponding to the data signal value to be applied to pixels connected to an i-th scan line Si. The green selection signal CLg provides the gate-on voltage to the green transistor Mgj, green transistor Mgj is turned on, and a green data signal Green(i) is applied to a green data line Dgj through the turned-on green transistor Mgj. In this case, the green data signal Green(i) is controlled and output with a lower slew rate, i.e. a slower rise/fall rate, to correspond to a period in which the green selection signal CLg has a gate-on voltage.

For a third time interval tb between the time when a gate-on voltage is applied as the green selection signal CLg and before a gate-on voltage is applied to the blue selection signal CLb, the data signal data[j] has the value of the data signal previously applied to pixels connected to the (i−1) the scan line (Si−1), indicated in FIG. 4 as blue data signal Blue(i−1). Thereafter, when a gate-on voltage is applied to the blue selection signal Clb, the data signal data[j], has the value, indicated in FIG. 4 as blue data signal Blue(i), corresponding to the data signal value to be applied to pixels connected to an i-th scan line Si. The blue selection signal CLb provides the gate-on voltage to the blue transistor Mbj, the blue transistor Mbj is turned on, and a blue data signal Blue(i) is applied to the blue data line Dbj through the turned-on blue transistor Mbj. In this case, the blue data signal Blue(i) is controlled and output with a lower slew rate, i.e. a slower rise/fall rate, to correspond to a period in which the blue selection signal CLb is has a gate-on voltage.

At the (Si+1) segment, for the first time interval tr, the data signal data[j] is red data signal Red(i) corresponding to an i-th scan line Si. Thereafter, when the red selection signal Clr has a gate-on voltage, the data signal data[j] is applied as a red data signal Red(i+1) corresponding to an (i+1)th scan line (Si+1). The red selection signal CLr provides a gate-on voltage to the red transistor Mrj, the red transistor Mrj is turned on, and a red data signal Red(i+1) is applied to the red data line Drj through the turned-on red transistor Mrj. In this case, the red data signal Red(i+1) is controlled and output with a lower slew rate, i.e. a slower rise/fall rate, to correspond to a period in which the red selection signal CLr has a gate-on voltage.

For the second time interval tg, the data signal data[j] is green data signal Green(i) corresponding to an i-th scan line Si. Thereafter, when the green selection signal CLg has a gate-on voltage, the data signal data[j] a green data signal Green(i+1) corresponding to an (i+1)th scan line (Si+1). The green selection signal CLg provides the gate-on voltage to the green transistor Mgj, the green transistor Mgj is turned on, and a green data signal Green(i+1) is applied to the green data line Dgj through the turned-on green transistor Mgj. In this case, the green data signal Green(i+1) is controlled and output with a lower slew rate, i.e. a lower rise/fall rate, to correspond to a period in which the green selection signal CLg has a gate-on voltage.

For the third time interval tb, the data signal data[j] is blue data signal Blue(i) corresponding to an i-th scan line Si. Thereafter, when a gate-on voltage is applied to the blue selection signal Clb, the data signal data[j] is a blue data signal Blue(i+1) corresponding to an (i+1)th scan line (Si+1). The blue selection signal CLb provides the gate-on voltage to the blue transistor Mbj, the blue transistor Mbj is turned on, and a blue data signal Blue(i+1) is applied to the blue data line Dbj through the turned-on blue transistor Mbj. In this case, the blue data signal Blue(i+1) is controlled and output with a lower slew rate, i.e. a slower rise/fall rate, to correspond to a period in which the blue selection signal CLb has a gate-on voltage.

In this way, during a first time interval tr, which occurs before a gate-on voltage is applied to the red color selection signal CLr, the red data signal applied to the pixels corresponding to an immediately preceding scan line is applied to the plurality of data lines D1-Dm. As a result, the data lines D1-Dm are pre-charged. That is, during second time interval tg, before the gate-on voltage is applied to selection signal CLr for the current scan line, the data lines D1-Dm are charged with the same red data signal previously applied to the pixels connected to the preceding scan line. During a second time interval tg, which occurs before a gate-on voltage is applied to the green color selection signal CLg, the green data signal applied to the pixels corresponding to an immediately preceding scan line is applied to the plurality of data lines D1-Dm. As a result, the data lines D1-Dm are pre-charged. That is, during second time interval tg, before a gate-on voltage is applied the selection signal CLg for the current scan line, the data lines D1-Dm are charged with the same green data signal previously applied to the pixels connected to the preceding scan line. During the third time interval tb, which occurs before a gate-on voltage is applied to the blue color selection signal CLb, the blue data signal applied to the pixels corresponding to an immediately preceding scan line is applied to the plurality of data lines D1-Dm. As a result, the data lines D1-Dm are pre-charged. That is, during third time interval tb, before a gate-on voltage is applied to the selection signal CLb for the current scan line, the data lines D1-Dm are charged with the same blue data signal previously applied to the pixels connected to the preceding scan line.

In general, large luminance differences do not occur between adjacent pixels. Therefore, except for an occasional special case, a voltage level of each of a red data signal Red(i), a green data signal Green(i), and a blue data signal Blue(i) that are applied to pixels connected to an i-th scan line Si is similar to a voltage level of each of a red data signal Red(i)−1, a green data signal Green(i−1), and a blue data signal Blue(i−1) that are applied to pixels connected to an (i−1)th scan line (Si−1), which is the immediately preceding scan line. Furthermore, a voltage level of each of a red data signal Red(i+1), a green data signal Green(i+1), and a blue data signal Blue(i+1) that are applied to pixels connected to an (i+1)th scan line (Si+1) is similar to a voltage level of each of a red data signal Red(i), a green data signal Green(i), and a blue data signal Blue(i) that are applied to pixels connected to i-th scan line Si, which is an immediately preceding scan line.

Because the data lines D1-Dm are charged with the data signal applied to pixels connected to an immediately preceding scan line before gate-on voltages are applied to each of the red selection signal CLr, the green selection signal CLg, and the blue selection signal CLb, at the moment that the red selection signal CLr, the green selection signal CLg, and the blue selection signal CLb are applied with a gate-on voltage, a rapid voltage change at data lines D1-Dm can be removed. That is, because the data lines D1-Dm are previously charged, while each of the red data signal, the green data signal, and the blue data signal is applied with a gate-on voltage, large changes in the voltage applied to data lines D1-Dm are unnecessary, and thus each of the red data signal, the green data signal, and the blue data signal may be controlled and output with a lower slew rate, i.e. slower rise/fall rate, and a rapid voltage change at data lines D1-Dm can be removed.

At the Si segment, the red data signal Red(i), the green data signal Green(i), and the blue data signal Blue(i) are applied with a low level voltage, and at an (Si+1) segment, a red data signal Red(i+1), a green data signal Green(i+1), and a blue data signal Blue(i+1) are applied with a high level voltage, and therefore noise resulting from a voltage change at a red data line Drj, a green data line Dgj, and a blue data line Dbj can be measured.

At the Si segment, a voltage V_Drj of the red data line Drj is lowered with a constant slew rate (i.e., constant fall rate) for a period during which a gate-on voltage is applied to the red selection signal CLr, a voltage V_Dgj of the green data line Dgj is lowered with a constant slew rate (i.e., constant fall rate) for a period during which a gate on voltage is applied to the green selection signal CLg, and a voltage V_Dbj of the blue data line Dbj is lowered with a constant slew rate (i.e., constant fall rate) for a period during which a gate-on voltage is applied to the blue selection signal CLb.

At the (Si+1) segment, a voltage V_Drj of the red data line Drj rises with a constant slew rate (i.e., constant rise rate) for a period during which the a gate-on voltage is applied to the red selection signal CLr, a voltage V_Dgj of the green data line Dgj rises with a constant slew rate (i.e., a constant rise rate) for a period during which a gate-on voltage is applied to the green selection signal CLg, and a voltage V_Dbj of the blue data line Dbj rises with a constant slew rate (i.e., constant rise rate) for a period during which a gate-on voltage is applied to the blue selection signal CLb.

At each of the first time interval tr, the second time interval tg, and the third time interval tb, in the case (indicated in FIG. 4 as Noise CASE 1) in which the data lines D1-Dm are not previously charged, at a moment that gate-on voltages are applied to the red selection signal CLr, the green selection signal CLg, and the blue selection signal CLb, a rapid voltage change occurs at the red data line Drj, the green data line Dgj, and the blue data line Dbj. Accordingly, at a wire of an adjacent touch sensor, coupling noise is represented with a peak.

At, however, each of the first time interval tr, the second time interval tg, and the third time interval tb, in the case (indicated in FIG. 4 as Noise CASE 2) in which the data lines D1-Dm are previously charged with each of a red data signal, a green data signal, and a blue data signal corresponding to that applied in an immediately preceding scan line, at a moment that gate-on voltages are applied to each of the red selection signal CLr, the green selection signal CLg, and the blue selection signal CLb, at the red data line Drj, the green data line Dgj, and the blue data line Dbj, a voltage change does not sharply occur. Therefore, at a wire of an adjacent touch sensor, coupling noise is minimized and hardly occurs.

Figure 5:
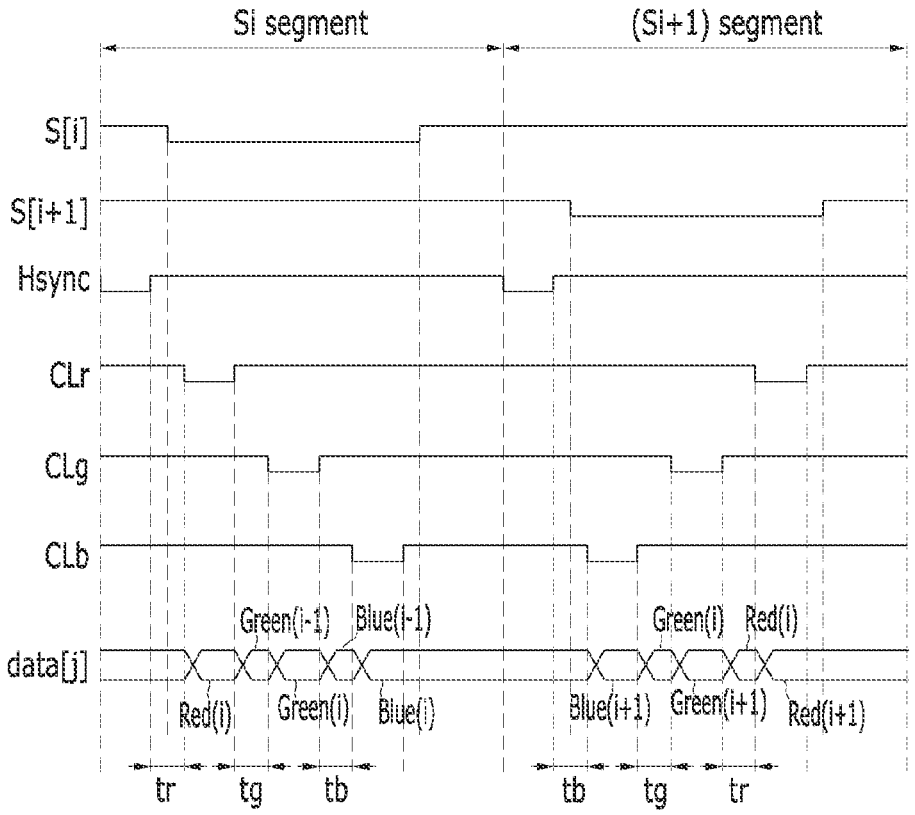
FIG. 5 is a timing diagram illustrating a method of driving a display device according to another example embodiment.

FIG. 5 is a timing diagram illustrating a method of driving a display device according to another example embodiment.

When describing a difference by comparing FIGS. 4 and 5, a gate-on signal is applied to a red selection signal CLr, a green selection signal CLg, and a blue selection signal CLb in a first order of the red selection signal CLr, the green selection signal CLg, and then the blue selection signal CLb at an Si segment. That is, at the Si segment, the red data lines, the green data lines, and the blue data lines are sequentially selected. At the (Si+1) segment, a gate-on voltage is applied to the red selection signal CLr, the green selection signal CLg, and the blue selection signal CLb in a second order of the blue selection signal CLb, the green selection signal CLg, and the red selection signal CLr. That is, at the (Si+1) segment, the blue data lines, the green data lines, and the red data lines are sequentially selected. Gate-on voltages are applied to the red selection signal CLr, the green selection signal CLg, and the blue selection signal CLb in a first order and a second order in a one scan line unit.

A segment in which a gate-on voltage is applied in the first order of the red selection signal CLr, the green selection signal CLg, and the blue selection signal CLb is referred to as a first scan line segment, and a segment in which gate-on voltages are applied in the second order of the blue selection signal CLb, the green selection signal CLg, and the red selection signal CLr, is referred to as a second scan line segment.

At the first scan line segment, the data signal data[j] is output in the order of a red data signal Red(i), an immediately preceding green data signal Green(i−1), a green data signal Green(i), an immediately preceding blue data signal Blue(i−1), and a blue data signal Blue(i). At the first scanning segment, before a gate-on voltages is applied to the red selection signal CLr, a red data signal Red(i−1) corresponding to the data signal for the immediately preceding scan line (Si−1) is applied, and thus at a time interval tr between a horizontal synchronization signal Hsync and a red selection signal CLr, it is unnecessary to separately output an immediately preceding red data signal Red(i−1).

At the second scan line segment, the data signal data[j] is output in the order of a blue data signal Blue(i+1), an immediately preceding green data signal Green(i), a green data signal Green(i+1), an immediately preceding red data signal Red(i), and a red data signal Red(i+1). At the second scan segment, before a gate-on voltages is applied to the blue selection signal CLb, a blue data signal Blue(i) corresponding to a data signal for the immediately preceding scan line Si is applied, and thus at a time interval tb between the horizontal synchronization signal Hsync and the blue data signal Blue(i+1), it is unnecessary to separately output an immediately preceding blue data signal Blue(i).

In a driving method of a display device of FIG. 5, the number of times in which data signals data[1]-data[m] that are applied to a plurality of data lines D1-Dm are changed and output can be reduced, compared with a driving method of FIG. 4.

Figure 6:
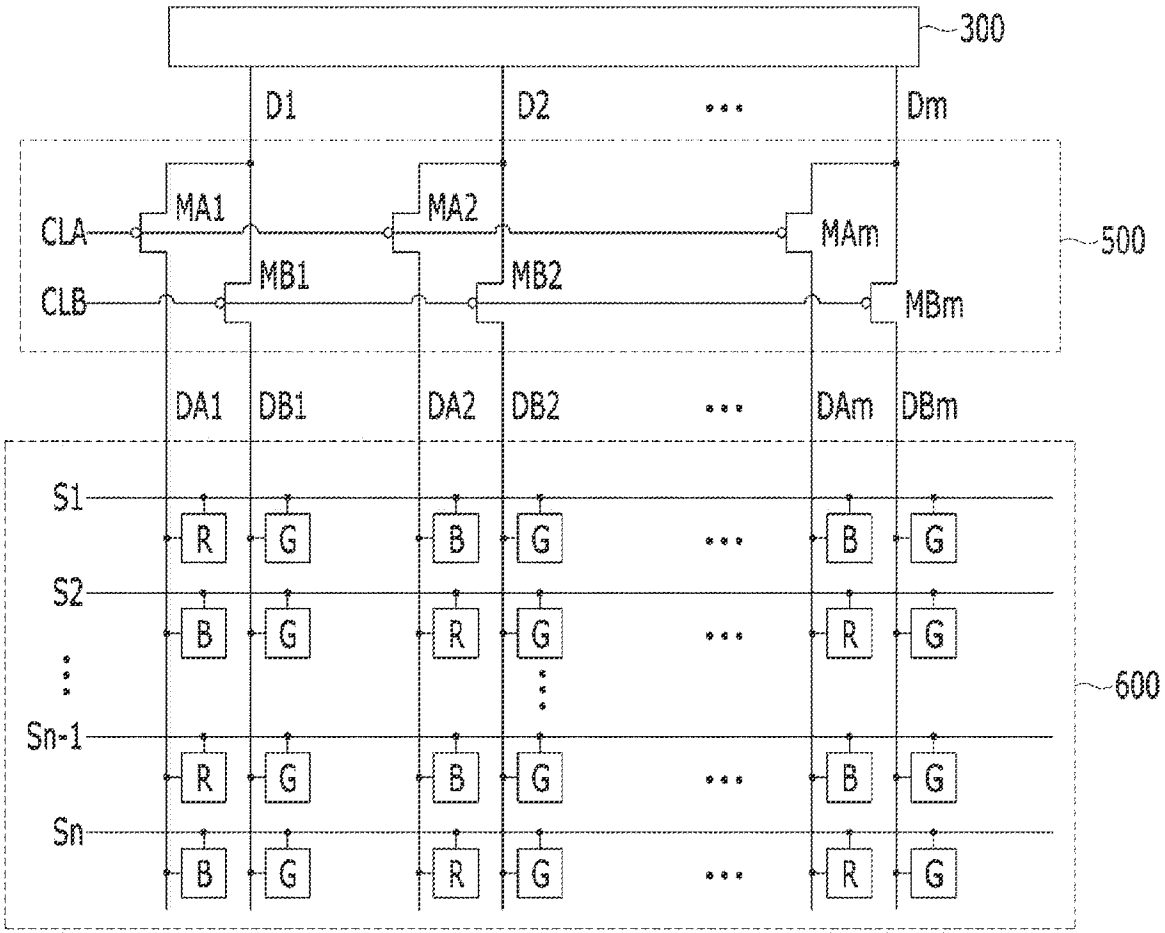
FIG. 6 is a circuit diagram illustrating a configuration of a display device according to another example embodiment.

FIG. 6 is a circuit diagram illustrating a configuration of a display device according to another example embodiment.

Referring to FIG. 6, the display unit 600 includes a plurality of pixels that are arranged in a PenTile structure in which a desired color is displayed by a temporal or spatial sum of light that is generated in a red pixel R, a green pixel G, a blue pixel B, and a green pixel G.

The demux unit 500 includes a plurality of first transistors MA1-MAm and a plurality of second transistors MB1-MBm that are turned on and off based on the fourth driving control signal CONT4.

The demux unit 500 generates a first selection signal CLA that controls the plurality of first transistors MA1-MAm based on the fourth driving control signal CONT4, and a second selection signal CLB that controls the plurality of second transistors MB1-MBm. Alternatively, the first selection signal CLA and the second selection signal CLB may be included in the fourth driving control signal CONT4.

The plurality of first transistors MA1-MAm each include a gate electrode to which the first selection signal CLA is applied, one electrode that is connected to data lines D1-Dm and the other electrode that is connected to first sub-data lines DA1-DAm.

The plurality of second transistors MB1-MBm each include a gate electrode to which the second selection signal CLB is applied, one electrode that is connected to data lines D1-Dm, and the other electrode that is connected to second sub-data lines DB1-DBm.

A plurality of red pixels R and a plurality of blue pixels B may be connected to the first sub-data lines DA1-DAm, and a plurality of green pixels B may be connected to the second sub-data lines DB1-DBm.

The plurality of first transistors MA1-MAm and the plurality of second transistors MB1-MBm may be, for example, p-channel field effect transistors. A gate-on voltage of the p-channel field effect transistor is a low level voltage, and a gate-off voltage thereof is a high level voltage.

At least one of the plurality of first transistors MA1-MAm and the plurality of second transistors MB1-MBm may be, for example, an n-channel field effect transistor. A gate-on voltage of the n-channel field effect transistor is a high level voltage, and a gate-off voltage thereof is a low level voltage.

A gate-on voltage may be applied to the first selection signal CLA and the second selection signal CLB at a predetermined time interval in a scan line unit. For example, after a gate-on voltage is applied to the first selection signal CLA and a the voltage of the first selection signal CLA is changed to a gate-off voltage, a gate-on voltage may be applied to the second selection signal CLB at a predetermined time interval.

During a period in which the first selection signal CLA has a gate-on voltage the data driver 300 applies data signals corresponding to the red pixels R, and data signals corresponding to the blue pixels B to the data lines D1-Dm. During a period in which the second selection signal CLB has a gate-on voltage, the data driver 300 applies data signals corresponding to the green pixels G to the data lines D1-Dm.

In this case, during predetermined time intervals that occur, in each case, before the gate-on voltage is applied to the first selection signal CLA and the second selection signal CLB, the data driver 300 applies a data signal to the data lines D1-Dm that is the same data signal as applied to data lines D1-Dm for the immediately preceding scan line.

Figure 7:
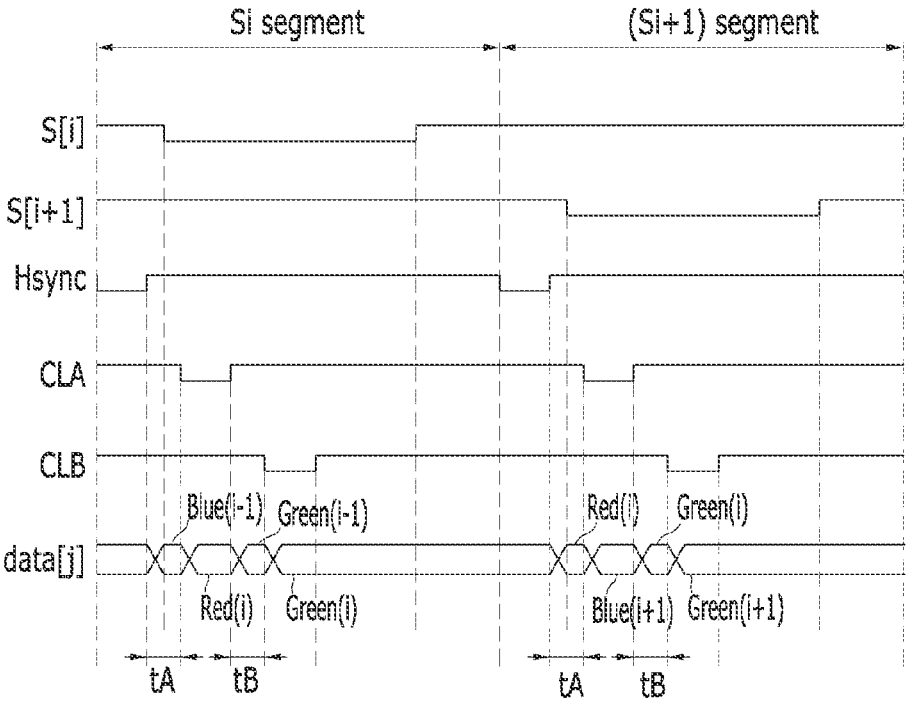
FIG. 7 is a timing diagram illustrating a method of driving a display device according to another example embodiment.

FIG. 7 is a timing diagram illustrating a method of driving a display device according to another example embodiment.

Referring to FIGS. 6 and 7, for better understanding and ease of description, an "Si segment," is a period of time in which a data signal corresponding to an i-th scan line Si is applied, and an "(Si+1) segment," is a period of time in which a data signal is applied to correspond to an (i+1)th scan line (Si+1), are illustrated (in this case, $2 \leq i \leq n-1$). A display data signal, data[j], that is applied to a j-th data line Dj is illustrated (in this case, $1 \leq j \leq m$).

The first selection signal CLA and the second selection signal CLB are synchronized to a horizontal synchronization signal Hsync, and are sequentially applied with a gate-on voltage at predetermined time intervals tA and tB. A segment in which gate-on voltages are applied to the first selection signal CLA and the second selection signal CLB is included in a segment in which a scan signal is applied with a gate-on voltage.

At the Si segment, for a first time interval tA between the time when a horizontal synchronization signal Hsync changes voltage level and before a gate-on voltage is applied to the first selection signal CLA, the data signal data[j] has the value of the blue data signal Blue(i−1) previously applied to pixels connected to the (i−1)th scan line (Si−1). Thereafter, when a gate-on voltage is applied to the first selection signal CLA, the data signal data[j] has the value of red data signal Red(i) corresponding to the data signal value to be applied to pixels connected to an i-th scan line Si. The first transistor MAj is turned on when a gate-on voltage is applied to the first selection signal CLA of a gate-on voltage, and a red data signal Red(i) is applied to the first sub-data line DAj through the turned-on first transistor MAj. In this case, the red data signal Red(i) is controlled and output with a lower slew rate (i.e., lower rise/fall rate) to correspond to a period in which the first selection signal CLA is applied with a gate-on voltage.

For a second time interval tB between the time when a gate-off voltage is applied to the first selection signal CLA and a gate-on voltage is applied to the second selection signal CLB, a data signal data[j] has the value of a green data signal Green(i−1) previously applied to pixels connected to the (i−1)th scan line (Si−1). Thereafter, when a gate-on voltage is applied to the second selection signal CLB, the data signal data[j] has the value of a green data signal Green(i) corresponding to the data signal value to be applied to pixels connected to an i-th scan line Si. The second selection signal CLB provides a gate-on voltage to the second transistor MBj, second transistor MBj is turned on, and a green data signal Green(i) is applied to the second sub-data line DBj through the turned-on second transistor MBj. In this case, the green data signal Green(i) is controlled and output with a lower slew rate (i.e., a lower rise/fall rate) to correspond to a period during which the second selection signal CLB has a gate-on voltage.

At the (Si+1) segment, for the first time interval tA, the data signal data[j] is red data signal Red(i) corresponding to an i-th scan line Si. Thereafter, when the first selection signal CLA has a gate-on voltage, the data signal data[j] is applied as a blue data signal Blue(i+1) corresponding to an (i+1)th scan line (Si+1). The first selection signal CLA provides a gate-on voltage to the first transistor MAj, the first transistor MAj is turned on, and the blue data signal Blue(i+1) is applied to the first sub-data line DAj through the turned-on first transistor MAj. In this case, the blue data signal Blue(i+1) is controlled and output with a lower slew rate, i.e. a lower rise/fall rate, to correspond to a period in which the first selection signal CLA has a gate-on voltage.

For a second time interval tB, the data signal data[j] is green data signal Green(i) corresponding to an i-th scan line Si. Thereafter, when a gate-on voltage is applied to the second selection signal CLB, the data signal data[j] is a green data signal Green(i+1) corresponding to an (i+1)th scan line (Si+1). The second transistor MBj is turned on when a gate-on voltages is applied to the second selection signal CLB, and the green data signal Green(i+1) is applied to the second sub-data line DBj through the turned-on second transistor MBj. In this case, the green data signal Green(i+1) is controlled and output with a lower slew rate, i.e. a lower rise/fall rate, to correspond to a period in which the second selection signal CLB has a gate-on voltage.

In this way, during a first time interval tA, which occurs before a gate-on voltage is applied to the first selection signal CLA, one of a blue data signal and a red data signal applied to the pixels corresponding to an immediately preceding scan line is applied to the plurality of data lines D1-Dm. As a result, data lines D1-Dm are pre-charged. That is, during first time interval tA, before the date-on voltage is applied to the first selection signal CLA for the current scan line, the data lines D1-Dm are charged with the same blue data signal or red data signal previously applied to the pixels connected to the preceding scan line. During a second time interval tB, which occurs before a gate-on voltage is applied to the second selection signal CLB, the green data signal applied to the pixels corresponding to an immediately preceding scan line is applied to the plurality of data lines D1-Dm. As a result, the data lines D1-Dm are pre-charged. That is, during second time interval tB, before a gate-on voltage is applied to the second selection signal CLB, the data lines D1-Dm are charged with the same green data signal previously applied to the pixels connected to the preceding scan line.

Because the data lines D1-Dm are charged with the data signal applied to pixels connected to an immediately preceding scan line before gate-on voltages are applied to each of the first selection signal CLA and second selection signal CLB, at the moment that the first selection signal CLA and the second selection signal CLB each are applied with a gate-on voltage, a rapid voltage change in data lines D1-Dm can be removed. That is, because the data lines D1-Dm are previously charged, while the first selection signal CLA and the second selection signal CLB each are applied with a gate-on voltage, large changes in the voltage applied to data lines D1-Dm are unnecessary, and thus a red data signal, a green data signal, and a blue data signal each may be controlled and output with a lower slew rate, i.e. a lower rise/fall rate, and a rapid voltage change in data lines D1-Dm can be removed. That is, in a wire of a touch sensor, coupling noise that can occur when there is a rapid voltage change in the data lines D1-Dm can be prevented.

While this disclosure has been described in connection with what is presently considered to be practical example embodiments, it is to be understood that the invention is not limited to the disclosed embodiments, but, on the contrary, is intended to cover various modifications and equivalent arrangements comprised within the spirit and scope of the disclosure, including the appended claims.

DESCRIPTION OF SYMBOLS

100: signal controller
200: scan driver
300: data driver
400: power supply unit
500: demux unit
600: display unit

What is claimed is:

1. A display device, comprising:

a display unit including a plurality of first color pixels, a plurality of second color pixels, and a plurality of third color pixels;

a scan driver that sequentially applies a gate-on voltage scan signal to a plurality of scan lines that are connected to the plurality of first color pixels, the plurality of second color pixels, and the plurality of third color pixels;

a demux unit that is connected to a plurality of first sub-data lines and a plurality of second sub-data lines; the plurality of first sub-data lines are directly connected to the plurality of first color pixels and the plurality of third color pixels, the first color pixels and the third color pixels are alternatively arranged according to the first sub-data lines, and a plurality of second sub-data lines are directly connected to the plurality of second color pixels, the second color pixels are only arranged according to the second sub-data lines, wherein the demux unit is configured to sequentially select the plurality of first sub-data lines and the plurality of second sub-data lines at a predetermined time interval; and a data driver configured to apply a data signal to each of the plurality of first sub-data lines and the plurality of second sub-data lines that are sequentially selected in the demux unit, and configured to apply a previous data signal to the plurality of first sub-data lines and the plurality of second sub-data lines, wherein the previous data signal has a same voltage as a voltage applied to one of the plurality of first sub-data lines and the plurality of second sub-data lines at an immediately preceding scan line segment before the predetermined time interval, wherein the data driver applies a first previous data signal applied to the plurality of first sub-data lines at a first scan line segment to the first sub-data line during a first time interval before the plurality of first sub-data lines are selected at a second scan line segment following the first scan line segment, and applies a second previous data signal applied to the plurality of first sub-data lines at the second scan line segment to the first sub-data line during the first time interval that is included in a third scan line segment following the second scan line segment, and wherein the data driver applies a third previous data signal applied to the plurality of second sub-data lines at the first scan line segment to the second sub-data line during a second time interval before the plurality of second sub-data lines are selected at the second scan line segment, and applies a fourth previous data signal applied to the plurality of second sub-data lines at the second scan line segment to the second sub-data line during the second time interval at the third scan line segment.

2. The display device of claim 1, wherein the demux unit repeatedly selects the plurality of first sub-data lines and the plurality of sub-data lines in a scan line unit.

3. A method of driving a display device, the method comprising:

applying a first data signal having a same voltage as a data signal applied to a first color data line during a first scan line segment to the first color data line during a first time interval that is included in a second scan line segment that follows the first scan line segment;

applying a third data signal to the first color data line to which the first data signal is applied;

applying a second data signal having a same voltage as a data signal applied to a second color data line during the first scan line segment to the second color data line during a second time interval that is included in the second scan line segment;

applying a fourth data signal to the second color data line to which the second data signal is applied;

applying a fifth data signal having a same voltage as a data signal applied to a third color data line during the first scan line segment to the third color data line during a third time interval that is included in the second scan line segment; and applying a sixth data signal to the third color data line to which the fifth data signal is applied, wherein a first color pixel is connected to the first color data line, a second color pixel is connected to the second color data line, and a third color pixel is connected to the third color data line.

4. The method of claim 3, wherein the first time interval is a time period between a time when an on-voltage is applied to a horizontal synchronization signal in a scan line unit and a time at which the third data signal is applied to the first color data line.

5. The method of claim 3, wherein the second time interval is a time period between the time at which the third data signal is applied to the first color data line and a time at which the fourth data signal is applied to the second color data line.

6. The method of claim 3, wherein the third time interval is a time period between the time at which the fourth data signal is applied to the second color data line and a time at which the sixth data signal is applied to the third color data line.

* * * * *